US007641768B2

(12) United States Patent
Patel et al.

(10) Patent No.: US 7,641,768 B2
(45) Date of Patent: Jan. 5, 2010

(54) METHOD AND JOINING ASSEMBLY FOR JOINING ENDS OF A FABRIC IN A PAPER MACHINE

(75) Inventors: Sanjay Patel, Summerville, SC (US); Robert Crook, Wilson, NC (US); Bryan Wilson, Raleigh, NC (US)

(73) Assignee: Voith Patent GmbH, Heidenheim (DE)

( * ) Notice: Subject to any disclaimer, the term of this patent is extended or adjusted under 35 U.S.C. 154(b) by 397 days.

(21) Appl. No.: 11/510,476

(22) Filed: Aug. 25, 2006
(Under 37 CFR 1.47)

(65) Prior Publication Data

US 2007/0095496 A1 May 3, 2007

Related U.S. Application Data

(60) Provisional application No. 60/711,584, filed on Aug. 26, 2005.

(51) Int. Cl.

| | |
|---|---|
| ***D21F 7/10*** | (2006.01) |
| ***D21F 7/08*** | (2006.01) |
| ***D21F 1/10*** | (2006.01) |
| ***D21F 1/12*** | (2006.01) |

(52) U.S. Cl. ..... 162/358.2; 162/348; 162/900; 162/902; 162/903; 162/904; 28/106; 28/110; 156/157

(58) Field of Classification Search ..... 162/116, 162/348, 358.1, 358.2, 361, 900–904; 28/110, 28/141, 142, 106; 156/502, 157, 505, 304.7, 156/304.4; 139/383 AA, 425 A; 428/58, 428/61, 193; 24/38, 31 B, 33 L
See application file for complete search history.

(56) References Cited

U.S. PATENT DOCUMENTS

| | | | | |
|---|---|---|---|---|
| 2,845,686 | A * | 8/1958 | Mason | 28/141 |
| 5,330,604 | A * | 7/1994 | Allum et al. | 156/304.7 |
| 5,480,604 | A * | 1/1996 | Johnson et al. | 264/138 |
| 5,731,063 | A | 3/1998 | Schultz et al. | 428/193 |

FOREIGN PATENT DOCUMENTS

| | | |
|---|---|---|
| WO | WO89/12717 | 12/1989 |

* cited by examiner

*Primary Examiner*—Eric Hug
(74) *Attorney, Agent, or Firm*—Taylor & Aust, P.C.

(57) ABSTRACT

A method of joining two ends of a fabric for use in a paper machine, carried out using a joining assembly, includes the steps of: placing a first end of the fabric on a first portion of a pin plate, the pins in the first portion of the pin plate extending into the first end; placing a second end of the fabric on a second portion of the pin plate such that the first end and the second end are in close proximity to each other in a join area, the pins in the second portion of the pin plate extending into the second end; and joining the first end and the second end in the join area. The method results in a perforated (and therefore permeable) join area.

10 Claims, 2 Drawing Sheets

METHOD AND JOINING ASSEMBLY FOR JOINING ENDS OF A FABRIC IN A PAPER MACHINE

CROSS REFERENCE TO RELATED APPLICATIONS

This is a non-provisional application based upon U.S. provisional patent application Ser. No. 60/711,584, entitled "IMPROVED METHOD TO JOIN BASE FABRIC FOR PMC APPLICATIONS", filed Aug. 26, 2005.

FIELD OF THE INVENTION

The present invention relates to paper machine clothing, and, more particularly, to a fabric for use in a press section of a paper machine.

BACKGROUND OF THE INVENTION

Generally speaking, a paper machine is made up of three sections, namely the forming section, press section and dryer section. In each section an endless engineered fabric is used to transport a continuous paper sheet through the paper machine. The structure of the fabrics for each section differs, as the functions of each section of the paper machine are different.

The fiber suspension is discharged in a fine, even, cross-machine stream onto a porous wire in the forming section, typically known as a fourdrinier wire. Water drains via gravity through the wire from the fiber suspension. A press fabric for the press section must be capable of rapidly absorbing and expelling water while supporting the newly formed paper sheet. By the time the paper web enters the drying section from the press section as much as fifty percent of the water has been removed from the web. The remaining water removal is completed in the dryer section. The paper web is carried by dryer fabrics transferring the web in succession to rotating dryer cylinders arranged along the length of the dryer section and is heated by high pressure steam circulated within the dryer cylinders.

Endless woven fabrics as described above require special weaving looms, making the fabrics costly and slow to manufacture. The ends of the fabric are joined together using, e.g., thermoplastic welding; however, joining by thermoplastic welding may be unreliable, has a relatively high rate of failure, may result in a weak joint, has poor wear resistance, and has poor caliper and porosity variation. If the fabric ends are "butted" together, the join area is prone to gap open as the felt elongates, or stretches, on the paper machine during use.

U.S. Pat. No. 5,731,063 (Schultz et al.) discloses a paper making felt and substrate which is bonded together with a fuse bonded joint using ultrasonic welding. Referring to FIG. 8, the ends of a substrate are clamped between stabilizing strips 64, and ultrasonic welder 75 welds the ends together. The heat generated by the ultrasonic welding renders the substrate substantially impermeable in the joint area.

PCT/GB89/00681 discloses a method for manufacturing a fabric for use in a paper making machine, wherein free ends 12, 13 of fabric 11 are folded over, butted together, and then sewn to the adjacent portion of the fabric (FIG. 2). The loops 17, 18 at the opposite ends of the fabric created by folding ends 12, 13 are joined together by inserting a pintle wire 19 through the loops 17, 18. Pintle wire 19 of course increases the physical size of the fabric in the join area.

What is needed in the art is a method and corresponding apparatus for joining ends of a fabric together which is simple, reliable and cost effective.

SUMMARY OF THE INVENTION

The present invention provides a method and assembly for joining two ends of a fabric, in which the two ends are held in a join area by a pin plate and joined adhesively or mechanically to create an endless loop of fabric.

The invention comprises, in one form thereof, a method of joining two ends of a fabric for use in a paper machine, including the steps of: placing a first end of the fabric on a first portion of a pin plate, the pins in the first portion of the pin plate extending into the first end; placing a second end of the fabric on a second portion of the pin plate such that the first end and the second end are in close proximity to each other in a join area, the pins in the second portion of the pin plate extending into the second end; and joining the first end and the second end in the join area, thereby creating a join that is more homogeneous with the body of the fabric, as the pins prevent the adhesive from "sealing" the fabric to the joined area and with relatively uniform caliper.

The invention comprises, in another form thereof, a joining assembly for joining two ends of a fabric for use in a paper machine. A pin plate has a plurality of outwardly extending pins. The pin plate includes a first portion and a second portion. A first end of the fabric is placed on the first portion of the pin plate, whereby the pins in the first portion of the pin plate extend into the first end. A second end of the fabric is placed on the second portion of the pin plate such that the first end and the second end are in close proximity to each other in a join area. The pins in the second portion of the pin plate extend into the second end. A joining device joins the first end and the second end in the join area.

Advantages of the present invention include an improved fabric join for woven and non-woven substrates having a uniform caliper, uniform density, uniform porosity, and superior strength and durability.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 2:
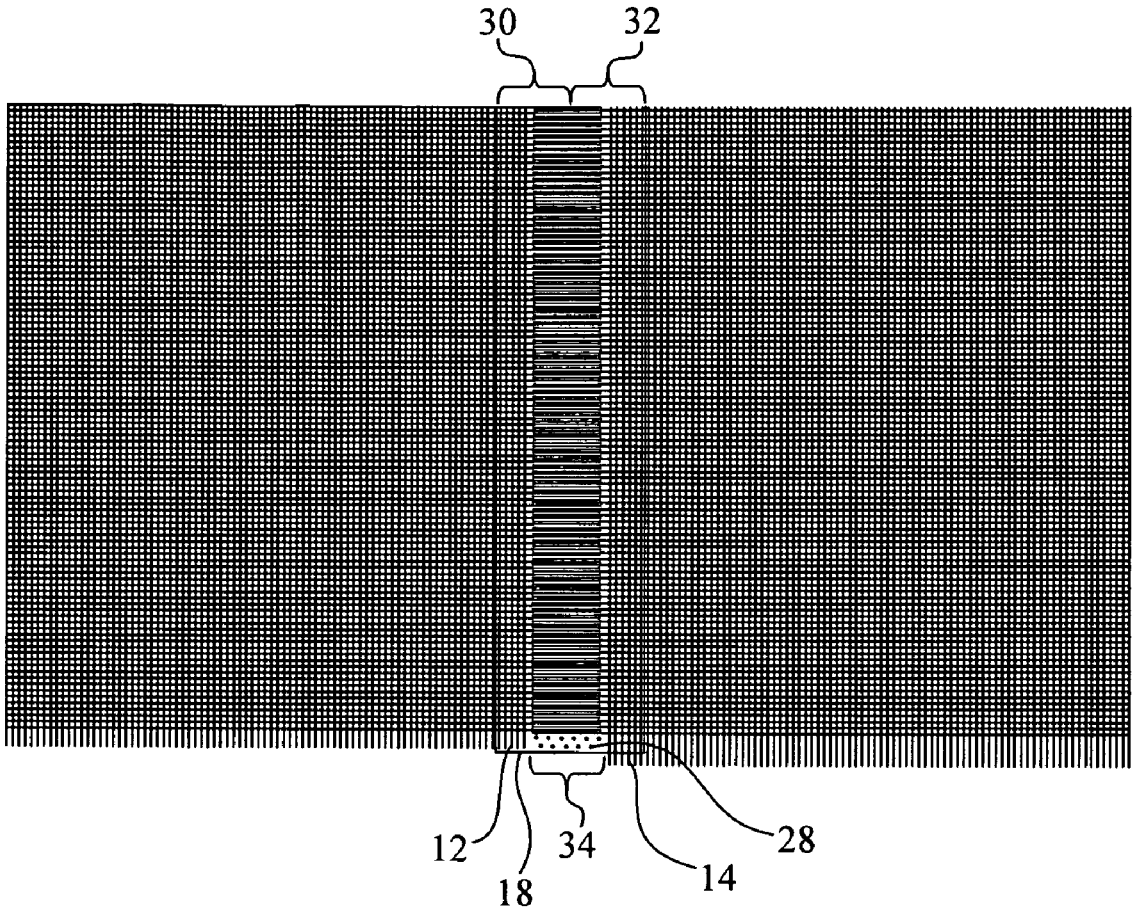
FIG. 2 is a top view of the joining assembly shown in FIG. 1.
Figure 3:
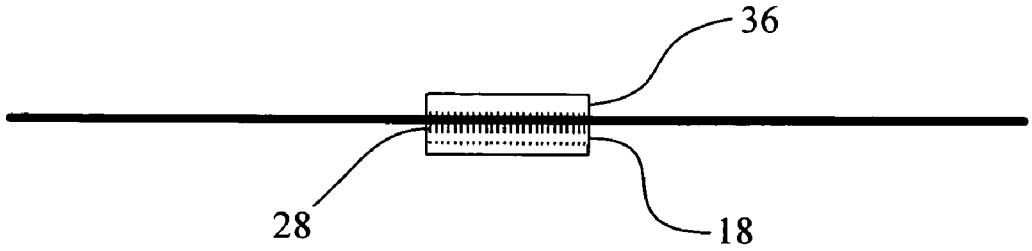
FIG. 3 is a side view of the joining assembly shown in FIGS. 1 and 2.

Referring now to the drawings, there is shown an embodiment of a joining assembly 10 of the present invention, used for joining a first end 12 of fabric 16 with a second end 14 of fabric 16 for use in a paper machine (not shown). Fabric 16, shown in more detail in FIGS. 2 and 3, is in the form of a woven press fabric for use in a press section of the paper machine, but may be differently configured depending upon the application. For example, fabric 16 may be a different type of woven fabric, or may be a non-woven fabric depending upon the application.

Joining assembly 10 generally includes a pin plate 18 and a joining device 20 which are used for joining first end 12 and second end 14 together such that fabric 16 defines an endless loop.

Fabric 16 has a machine direction (MD) 22 and a cross-machine direction (CD) 24. Fabric 16 has a width in the cross-machine direction 24 which may vary depending upon the application. For example, fabric 16 may have a width in the cross-machine direction 24 of between approximately 1 meter in the case of a pilot paper machine to up to 10 meters in the case of a production paper machine.

Pin plate 18 has a width which is slightly wider than the corresponding width of fabric 16 in the cross-machine direction 24. However, pin plate 18 may also have a width which is less than the width of fabric 16 in the cross-machine direction, and be used in an endwise sequential manner across the width in the cross-machine direction 24 of fabric 16.

Pin plate 18 includes a base 26 and a plurality of pins 28 which extend outwardly from base 26. Base 26 may be made from any suitable material, such as metal, a suitable composite, nylon, etc. Pins 28 are preferably metal pins, but could be made from any suitable material such as plastic, etc. The exact configuration of pins 28, as well as the attachment method between pins 28 and base 26 can vary, depending upon the application. Pin plate 18 is subdivided into a first portion 30 and a second portion 32. First end 12 of fabric 16 is received in first portion 30, and second end 14 of fabric 16 is received in second portion 32. A join area 34 lying in coincidence with a sub-portion of each of first portion 30 and second portion 32 defines an area in which first end 12 and second end 14 are in close proximity to each other and permanently joined together, as will be described in more detail hereinafter.

Figure 1:
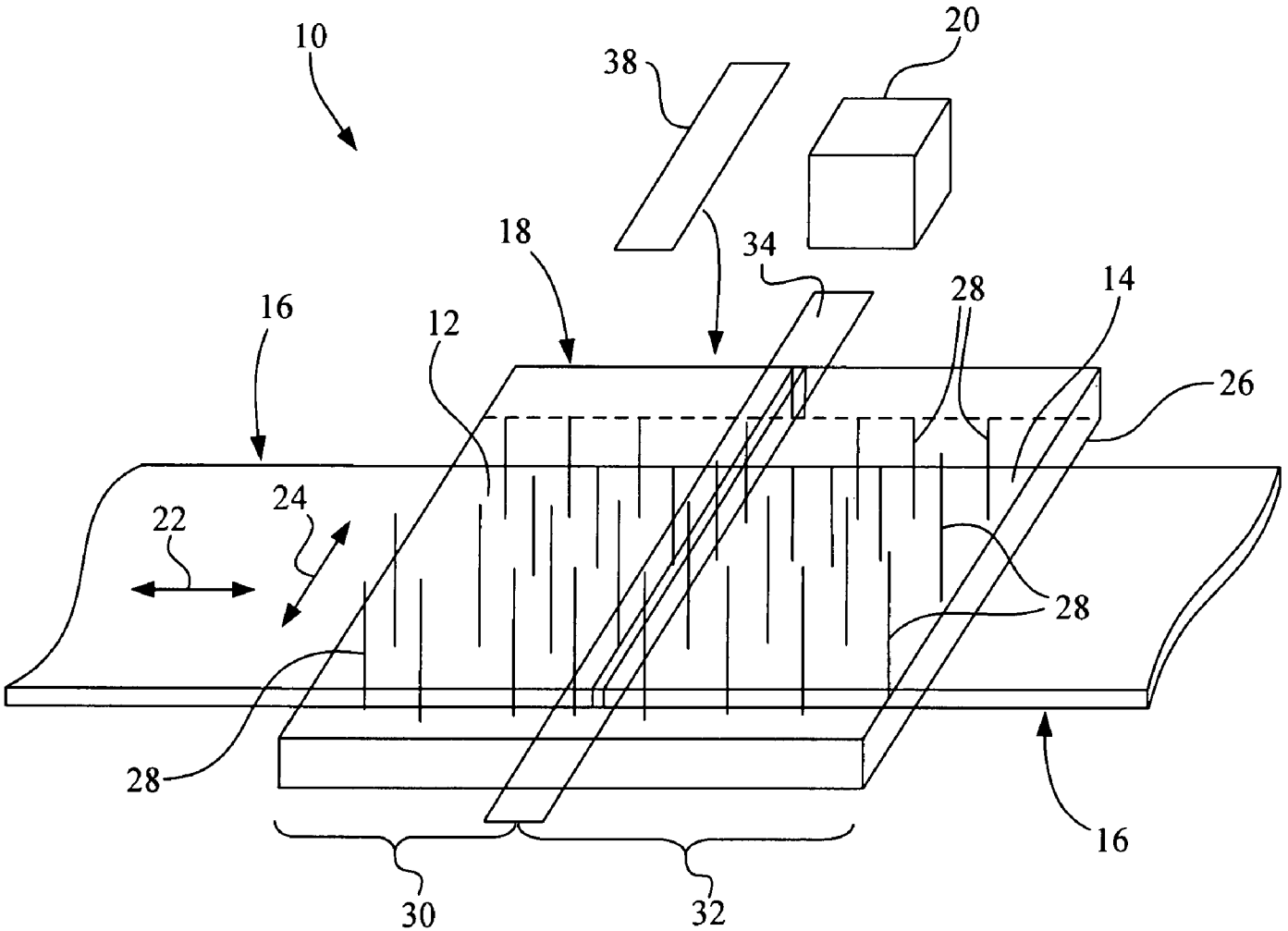
FIG. 1 is a perspective view of an embodiment of a joining assembly of the present invention, used to carry out the method of the present invention for joining ends of a fabric together.

Joining device 20 is schematically shown as a block in FIG. 1, and either adhesively or mechanically bonds first end 12 and second end 14 together. When configured as an adhesive applicator, joining device 20 may apply an adhesive such as an elastomer, a thermal setting polymer or a thermal plastic to join area 34. In one embodiment, joining device 20 is an adhesive applicator which applies an adhesive to join area 34, and a mating cover 36 overlying pin plate 18 is used to set the correct thickness of the elastomer and cure the elastomer.

In the event that joining device 20 is configured to mechanically bond first end 12 and second end 14 together, then joining device 20 is preferably configured as a needle puncher for mechanically bonding first end 12 and second end 14 together. In this case, an optional scrim 38 (FIG. 1) may also be used in joining first end 12 and second end 14 together. Scrim 38 is applied to join area 34 (as indicated by the dashed line) and needle punched together with first end 12 and second end 14 using joining device 20 in the form of a needle puncher.

An embodiment of the method of the present invention for joining first end 12 with second end 14 will now be described in greater detail. For the described joining method, it is assumed that fabric 16 is a woven press fabric, and joining device 20 is an adhesive applicator.

First end 12 and second end 14 of fabric 16 are first fringed by removing fibers in the cross-machine direction 24 using a suitable fringing technique. First end 12 is placed on first portion 30 of pin plate 18 such that pins 28 extend into and through first end 12. Similarly, second end 14 is placed on second portion 32 of pin plate 18 such that pins 28 extend into and through second end 14. The fringed ends of first end 12 and second end 14 (i.e., the fibers of first end 12 and second end 14 extending in machine direction 22) are positioned to overlap with each other in join area 34 (see FIG. 2) between approximately 1 mm to 12 mm, preferably approximately 3 mm (also corresponding to the width of join area 34). Adhesive applicator 20 then applies an elastomer adhesive over joined area 34. Cover 36 is placed over pin plate 18 and is positioned relative to pin plate 18 to provide a desired thickness of the elastomer. Cover 36 is held in place while the elastomer cures, and may also optionally be heated to assist in the curing process. Cover 36 and pin plate 18 are then removed from fabric 16, which is then ready for use in the press section of a paper machine. After being joined, join area 34 has a maximum thickness of not more than 2.5 times the thickness of fabric 16 (outside join area 34), and a minimum thickness of not less than the thickness of fabric 16 (outside join area 34). Join area 34 is permeable to air and water.

In the embodiment of the joining method described above, first end 12 and second end 14 are fringed prior to joining using joining assembly 10 of the present invention. However, it will be appreciate that first end 12 and second end 14 need not be fringed, depending upon the application. Further, in the embodiment of the joining method described above, pin plate 18 extends along cross-machine direction 24 of fabric 16. It will also be appreciated that joining assembly 10 may be used for joining a fabric 16 along machine direction 22, or may also be used at an angled bias to cross-machine direction 24 (such as if first end 12 and second end 14 are formed with a tail).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A method of joining two ends of a fabric for use in a paper machine, the method comprising the steps of:

placing a first end of the fabric on a first portion of a pin plate, the pins in the first portion of the pin plate extending into the first end;

placing a second end of the fabric on a second portion of the pin plate such that the first end and the second end are in close proximity to each other in a join area of the pin plate and thereby extend away from each other in an end-to-end relationship, the pins in the second portion of the pin plate extending into the second end; and joining the first end and the second end together in the join area to create a continuous, endless loop of fabric.

2. The method of claim 1, wherein the joining step comprises one of adhesive bonding and mechanically bonding the first fabric end and the second fabric end in the join area.

3. The method of claim 2, wherein the joining step comprises adhesive bonding the first fabric end and the second fabric end using an adhesive comprised of at least one of an elastomer, a thermosetting polymer and a thermoplastic.

4. The method of claim 2, including the step of applying a scrim to the join area, and the joining step comprises mechanically bonding the first fabric end and the second fabric end in the join area.

5. The method of claim 4, wherein the joining step comprises needle punching the scrim with each of the first fabric end and the second fabric end in the join area.

6. The method of claim 1, wherein the fabric comprises a woven fabric, and including the steps of:

fringing the first fabric end in a cross-machine direction; and fringing the second fabric end in the cross-machine direction;

the first and second placing steps including overlapping the fringed first fabric end and the fringed second fabric end in the join area.

7. The method of claim 1, wherein the fabric has a cross-machine direction, and the join area extends in the cross-machine direction.

8. The method of claim 1, wherein the fabric has a machine direction and a cross-machine direction, and the join area extends one of in the machine direction, the cross-machine direction, and at an angled bias to the cross-machine direction.

9. The method of claim 1, wherein the plurality of pins in the first portion of the pin plate extend into and through the first end of the fabric, and the plurality of pins in the second portion of the pin plate extend into and through the second end of the fabric.

10. The method of claim 1, wherein the fabric comprises a press fabric for use in a pits section of the paper machine.

* * * * *